US012325551B2

(12) United States Patent
Künnemann et al.

(10) Patent No.: US 12,325,551 B2
(45) Date of Patent: Jun. 10, 2025

(54) FRAME FOR PALLETS

(71) Applicant: GEORG UTZ HOLDING AG, Bremgarten (CH)

(72) Inventors: Patrick Künnemann, Salzbergen (DE); Axel Ritzberger, Altendorf (CH)

(73) Assignee: GEORG UTZ HOLDING AG, Bremgarten (CH)

( * ) Notice: Subject to any disclaimer, the term of this patent is extended or adjusted under 35 U.S.C. 154(b) by 171 days.

(21) Appl. No.: 18/246,882

(22) PCT Filed: Sep. 14, 2021

(86) PCT No.: PCT/IB2021/058340
§ 371 (c)(1),
(2) Date: Mar. 28, 2023

(87) PCT Pub. No.: WO2022/069983
PCT Pub. Date: Apr. 7, 2022

(65) Prior Publication Data

US 2023/0373684 A1 Nov. 23, 2023

(30) Foreign Application Priority Data

Oct. 1, 2020 (CH) ..... 1249/20

(51) Int. Cl.
*B65D 19/38* (2006.01)
*B65D 19/06* (2006.01)

(52) U.S. Cl.
CPC ..... *B65D 19/385* (2013.01); *B65D 19/06* (2013.01); *B65D 2519/00532* (2013.01); *B65D 2519/00592* (2013.01); *B65D 2519/00711* (2013.01)

(58) Field of Classification Search
CPC ..... B65D 19/385; B65D 19/06; B65D 2519/00592; B65D 2519/00532; B65D 2519/00711; B65D 19/00; B65D 19/12
(Continued)

(56) References Cited

U.S. PATENT DOCUMENTS

2004/0232146 A1* 11/2004 Kessler ..... B65D 19/12 220/6
2013/0228574 A1* 9/2013 Hill ..... B65D 77/061 220/826
(Continued)

FOREIGN PATENT DOCUMENTS

DE 26 57 859 A1 12/1977
DE 102011000841 A1 * 5/2012 ..... B65D 19/0093
(Continued)

OTHER PUBLICATIONS

International Search Report mailed on Dec. 10, 2021, in connection with corresponding International Application No. PCT/IB2021/058340 (7 pp., including machine-generated English translation).

*Primary Examiner* — Rafael A Ortiz
(74) *Attorney, Agent, or Firm* — Greer, Burns & Crain, Ltd

(57) ABSTRACT

A height-adjustable frame for a pallet and for accommodating an insert for goods has supports including upper and lower elements connected to one another via a hinge. The lower element and the upper elements can be pivoted towards and away from one another. In a first position, the upper and lower elements are moved towards one another and the support forms a maximum height. In a second position, the lower element is pivoted away from the upper element, and the support forms a sub-height. A height adjustment allows goods of different sizes to be transported via an insert, which is fastened on the frame. The height adjustment allows goods to be transported using inserts of
(Continued)

different depths and allows empty transportation with a smaller volume. The frame is stackable and can be transported using pallet containers or twin-wall sheets.

14 Claims, 7 Drawing Sheets

(58) Field of Classification Search
USPC ..... 206/386, 600; 108/54.1, 56.1, 56.3
See application file for complete search history.

(56) References Cited

U.S. PATENT DOCUMENTS

| | | | | |
|---|---|---|---|---|
| 2015/0014265 | A1 | 1/2015 | Zhu | |
| 2020/0085187 | A1 | 3/2020 | Zhao | |
| 2020/0277103 | A1 * | 9/2020 | Kiolbasa | B65D 19/385 |

FOREIGN PATENT DOCUMENTS

| | | | | | |
|---|---|---|---|---|---|
| GB | 1299219 | | * | 12/1972 | |
| GB | 1 555 669 | A | | 11/1979 | |
| GB | 2073149 | | * | 10/1981 | |
| JP | 2001-018648 | A | | 1/2001 | |
| WO | 96/41754 | A2 | | 12/1996 | |
| WO | WO-03033380 | A2 | * | 4/2003 | B65D 19/12 |
| WO | WO-2016035056 | A1 | * | 3/2016 | B65D 19/12 |
| WO | 2019/056073 | A1 | | 3/2019 | |
| WO | WO-2020011158 | A1 | * | 1/2020 | B65D 11/18 |
| WO | 2020/061626 | A1 | | 4/2020 | |

* cited by examiner

FRAME FOR PALLETS

CROSS-REFERENCE TO RELATED APPLICATIONS

This application is a National Stage application of International Patent Application No. PCT/IB2021/058340, filed Sep. 14, 2021, which claims priority to Swiss Patent Application No. 1249/20, filed Oct. 1, 2020, the disclosures of which each of which are incorporated herein by reference in their entirety.

TECHNICAL FIELD

The invention relates to a frame for pallets which can be placed on a pallet and in which goods can be placed for transport. In particular, the invention relates to supports at the corners of the frame and in particular to supports which are height-adjustable.

BACKGROUND OF THE INVENTION

Frames for pallets typically consist of four corner supports arranged in the corners of a pallet, and of struts connecting the upper ends of the supports. The struts can be arranged in a rectangle or crossed, thereby connecting the upper ends of the supports across the diagonal. Such frames allow placing goods on pallets as well as stacking such frames. The supports can have a fixed height or be height-adjustable.

A pallet frame is known, for example, from WO2020/061626. It has four supports which are placed on a pallet and the upper ends of which are connected by diagonally running struts. The supports can be extended telescopically in that an inner support part is enclosed by an outer support part and can be slidingly moved in and out in this outer support part. Both supports have several holes distributed along their length, into which pins are inserted to fix a given length of the supports.

Another frame for pallets is disclosed in JP2001-18648, which likewise has length-adjustable supports in telescope-like design and fixing pins. The upper ends of the supports are connected with rectangularly arranged cross struts. Horizontal reinforcing struts additionally connect the supports at partial heights.

SUMMARY

It is the object of the present invention to provide a frame for a pallet and for holding an insert for goods, wherein the height of the frame is adjustable in a simple manner.

A frame for a pallet and for accommodating an insert for goods has four supports, each comprising a foot at its lower end and a head at its upper end, wherein the head of each support is fastened to the frame. The four supports are at least in two parts, each having an upper element and a lower element pivotally connected to each other by means of a hinge. The upper element comprises the head of the support and extends downwards from this head to a lower end of the upper element, the head being fastened to the frame. The lower element comprises the foot of the support and extends from the foot upwards on the one side to the lower end of the upper element and on the other side to the hinge.

The frame comprises four horizontally extending sides that form a rectangular perimeter, with the supports being fastened to the corners of the rectangle. By means of the hinge, the lower and upper elements are pivotable towards each other and away from each other. In a first position, the upper element and the lower element of the support are moved towards each other by means of the hinge in that surfaces of the upper and lower elements facing each other are in contact with each other and the support has a maximum height. In a second position, the lower element is pivoted away from the upper element in the direction of the horizontal and towards the frame, i.e., towards the sides of the frame that extend horizontally and form a perimeter so that in this second position, the support has a smaller height, thus forming a partial height.

The four supports can each be adjusted to two different heights by the two elements connected to the hinge. In the first position, hereinafter called the closed position, the lower element is moved towards the upper element so that the surfaces of the two elements facing each other are in contact with each other. In this position, the two elements form a full-height support. In the second position, hereinafter called the open or unfolded position, the lower element is pivoted 90° or nearly 90° away from the upper element and towards the frame, similar to a flap, giving the support a partial height equal to the height of the upper element.

A height adjustment of the supports enables the transport of goods of different sizes by means of an insert that can be detachably fastened in the frame in a number of ways, so that depending on the size of the goods, inserts of different depths and inserts with different partitions can be attached.

The frame can be equipped with an insert made of textile fabric, plastics or other material such as cardboard or metal which, for example, has several partitions.

In one embodiment of the frame according to the invention, an insert for accommodating goods can be detachably fastened to the frame.

In one embodiment, the insert is made of plastics, wherein the inner sides of the frame have projections on which the insert is held in the frame. As such, the insert is removable from the frame or replaceable with another insert, for example of a different depth.

In a particular embodiment, the insert comprises thermoformed parts.

In another embodiment, the frame has elements to which an insert can be fastened or hooked. These elements can be, for example, hooks, tabs, or snap fasteners.

In yet another embodiment, the frame has an insert that is made of textile material and is glued or welded to the frame. Textile inserts are flexible and can be used with full-height supports as well as partial height supports.

Goods can be transported in compartments of an insert of appropriate size and depth. If the goods are larger or more numerous, the frame with the full-height supports can be used and an insert having a large depth can be fastened therein. If the goods are smaller or less numerous, the supports can be reduced in height and an insert of lesser depth can be fastened to the frame.

In particular, the invention has the advantage that a partial height of the supports can be achieved in a simple, easy and quick manner. Adjusting the height does not require any auxiliary means, tools or further loose elements for fixing the selected height of the supports.

The frames according to the invention with height-adjustable supports can either be stacked directly on top of each other and also placed on any pallets by forming a top part along the perimeter of the pallet.

In doing so, a desired height of the supports can be set in a stack depending on the application.

When a partial height is set, for example, multiple frames of this type can be stacked on top of each other and transported, wherein the total volume of the stack, for example for empty transportation, is significantly smaller than in a stack with frames with full-height supports.

In one embodiment of the invention, the axis of the hinge is in each case parallel to one of the sides of the frame, i.e. parallel to the short or long side of the rectangular frame. This makes it possible that the lower element of a support is moved under the frame in each case parallel thereto and thus remains within the perimeter of the rectangular frame and is not outside or within the frame.

In one embodiment of the invention, the hinge is located in the upper region of the upper element of the support. In such an arrangement, the hinge is located close to the frame. Thus, when the lower element is pivoted upwards and away from the upper element, the lower element is in a horizontal position near the frame where it can be fixed by suitable means. In one variant of the invention, the hinge is located at any location on the upper element of the support. In this case, the lower element is pivoted upwards toward the frame by 90° or more.

In one embodiment of the invention, the surfaces of the lower element and the upper element facing each other extend at an angle to the vertical. Thus, the aforementioned surfaces of the upper and lower elements that are in contact with each other at the full height of the support run at an angle to the vertical. The surfaces thus formed at an angle effect that both the upper and lower elements are optimally stable, which results in the fact that the upper element in its upper region and the lower element in its lower region are as wide as possible. The transmission of the weight of the pallet through the two elements of the support is thus optimally distributed, so that the two elements of the support are optimally loaded and thus remain stable for a longer time. In addition, this design also reduces the load on the hinge.

In one variant, the surfaces of the lower element and the upper element facing each other run horizontally or vertically. This variant is less robust compared to the above-mentioned embodiment, but is a feasible option.

In one embodiment of the invention, the upper element and the lower element of each support are connectable to each other in the closed position by means of a releasable snap connection. The snap connection allows the lower element to be attached to the upper element when they have been pivotally brought together and the support is at its full height. The releasable snap connection also allows the lower element to be easily released and pivoted outwards again to achieve a partial height of the support.

In one embodiment of the invention, the frame has a recess on its upper side in each of the corners. This recess serves for the fixation of the position of another frame which is stacked thereon.

In a further embodiment of the invention, the foot of each support, i.e. the lower end of the lower element, has a downwardly directed projection. This projection is used for attachment to a pallet or a further frame arranged below. The projection has a shape that can be inserted into a corresponding recess in the pallet or lower further frame, so that the frame with the four supports can be locked onto the pallet or lower further frame In a further embodiment of the invention, the lower end of the upper element also has a downwardly directed projection. The projection, similar to the aforementioned projection on the lower element, has a shape that can be inserted into a corresponding recess in a pallet or in a further frame therebelow. This allows the frame with the four supports to be locked at partial height on a pallet or further frame.

In a particular embodiment of the invention, the projection at the lower end of the lower element, i.e. at the foot of the support, has a cross-section which has a right angle. Such a projection can be inserted and locked in a suitably shaped recess having a right angle in the corner of a frame or a pallet.

In one embodiment of the invention, the projection has an edge at the lower end of the upper element. An edge can serve to provide a releasable snap connection between the upper and lower elements when in the closed position, for example in that a barb at the lower end of the upper element can be locked to the edge.

In one embodiment of the invention, the lower element comprises not only one part but two parts, each pivotally connected to the upper element by means of a hinge. The two hinges are arranged on either side of the upper element, i.e. one hinge is arranged on one side of the upper element and the other hinge is arranged on the opposite side of the upper element. This makes it possible that the two parts of the lower element can each be pivoted upwards towards the frame to one side of the upper element. To adjust the height of the support to a partial height, the two parts of the lower element are each pivoted at their hinge away from the upper element parallel to the frame and brought into a position parallel to the frame.

In a first variant of this design, both parts of the lower element are implemented to be of equal length.

In a second variant of this design, the first and the second part of the lower element are implemented to be of unequal length. This variant enables further height adjustment of the support, so that the support can be set to a total of three different heights. In the first setting, the support has its full height, wherein the lower element is vertical and both parts of the lower element are not pivoted out, i.e. are in the closed position and are vertical. In the second setting, the support has a first partial height wherein the first of the two parts of the lower element is pivoted out, i.e. in the folded-out position. The second part of the lower element is still in the closed position and is vertical. In this first partial height, the height of the support is determined by the upper element and the second part of the lower element. In the third height setting, both the first and second parts of the lower element are pivoted away from the upper element, giving the support a second partial height. In this setting, the second partial height of the support is reached at a height equal to the height of the upper element.

In another embodiment, one or both parts of the lower element in its pivoted-out position can be fastened to the lower side of the frame when the hinge is open. For example, the parts of the lower element can be fastened by means of a releasable snap connection. Any other fastenings are conceivable.

One or more stacks of multiple frames according to the invention can be easily placed in a foldable pallet container or on a pallet having peripheral side walls of twin-wall sheets attached onto the pallet. In this case, the supports of the frame are at full height or folded in at partial height. Placement of stacks of frames in the mentioned containers or sidewalls enables efficient and protected transportation of goods. Pallet containers as well as the side walls made of twin-wall sheets can be covered in a closing manner with a cover plate.

Further advantages and features of the invention are explained in more detail below with reference to exemplary embodiments shown in schematic drawings.

BRIEF DESCRIPTION OF THE DRAWINGS

FIGS. 10*a* and 10*b* show two applications of the frame according to the invention, of which FIG. 10*a* shows two stacks of frames according to the invention arranged on a pallet and enclosed by side walls of twin-wall sheets and FIG. 10*b* shows two such stacks arranged in a pallet container.

In the figures, the same reference signs have been used for the same elements in each case, and first-time explanations relate to all figures unless expressly stated otherwise.

DESCRIPTION OF THE PREFERRED EMBODIMENTS

Figure 1:
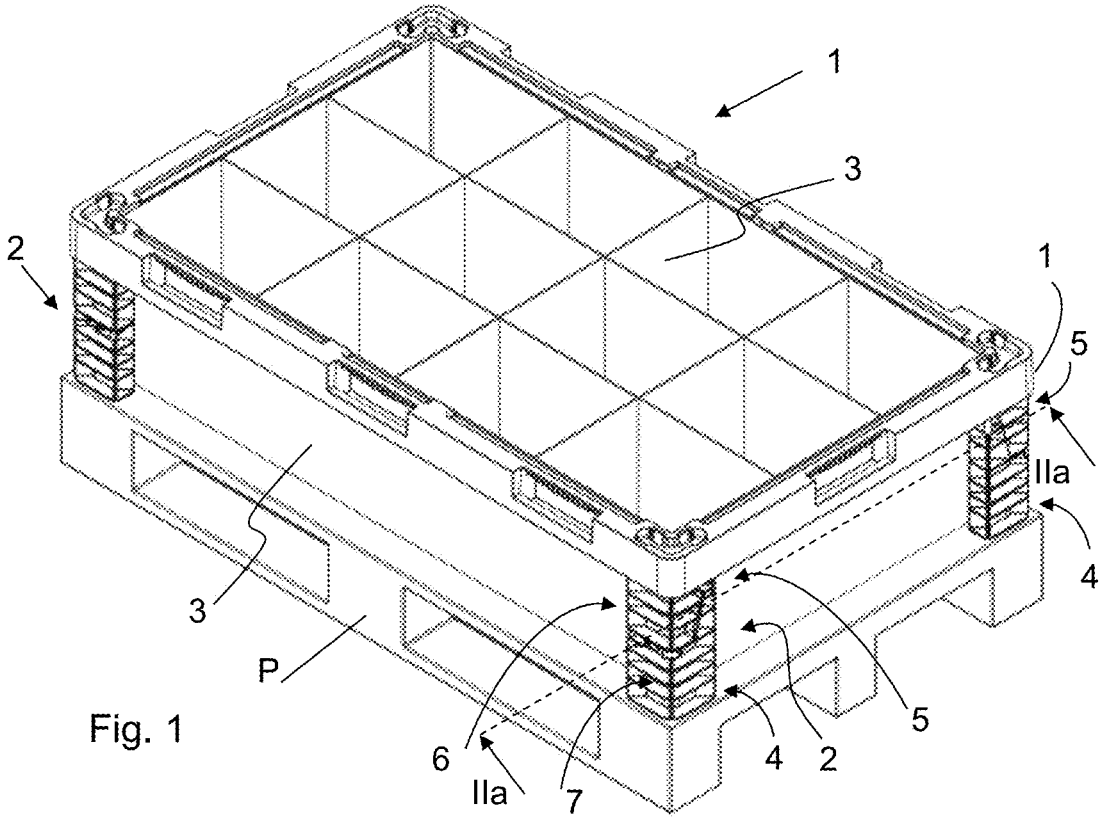
FIG. 1 shows a frame according to the invention with four supports in a full-height position, the lower element consisting of one part.

FIG. 1 shows a frame 1 according to the invention with four supports 2, which frame can be placed on a pallet P and in which an insert 3 for goods is arranged. The supports 2 extend from a foot 4 to a head 5, the head 5 being fastened to the frame 1. The supports 2 each have an upper element 6 and a lower element 7, which are pivotally connected to each other, as shown in FIGS. 2*a*-2*c*, and serve for height adjustment of the supports 2.

Figure 2A:
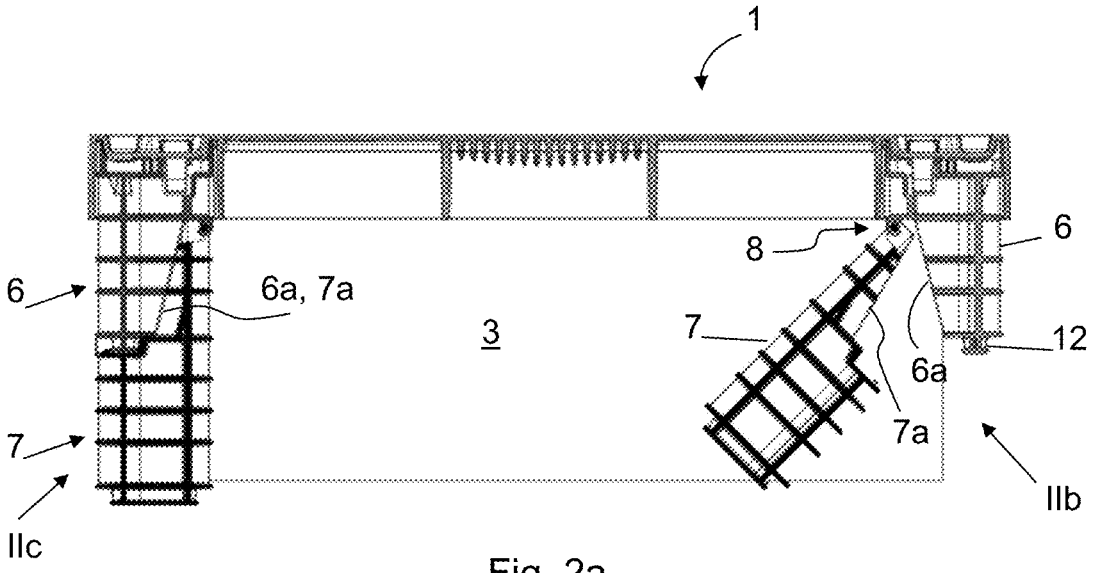
FIG. 2*a* shows a sectional drawing of the frame from FIG. 1 according to IIa-IIa in FIG. 1 and two supports in a side view, one support being shown with a closed hinge and the other support being shown with a partially open hinge.

FIG. 2*a* shows two supports 2 of the frame 1, which are shown in different positions. With the one of the supports (shown on the left), the upper element 6 and the lower element 7 are joined together in that the surfaces 6*a* and 7*a* facing each are in contact with each other. They form the closed position in which both elements are vertical. With the other support (shown on the right), the lower element 7 is pivoted from the upper element 6 by means of a hinge 8 parallel to and towards the frame 1. The surfaces 6*a* and 7*a* of the upper and lower elements 6 and 7, respectively, are each complementarily shaped such that they come to rest on each other when the hinge 8 is closed and the lower element 7 is in a vertical position.

Figure 2B:
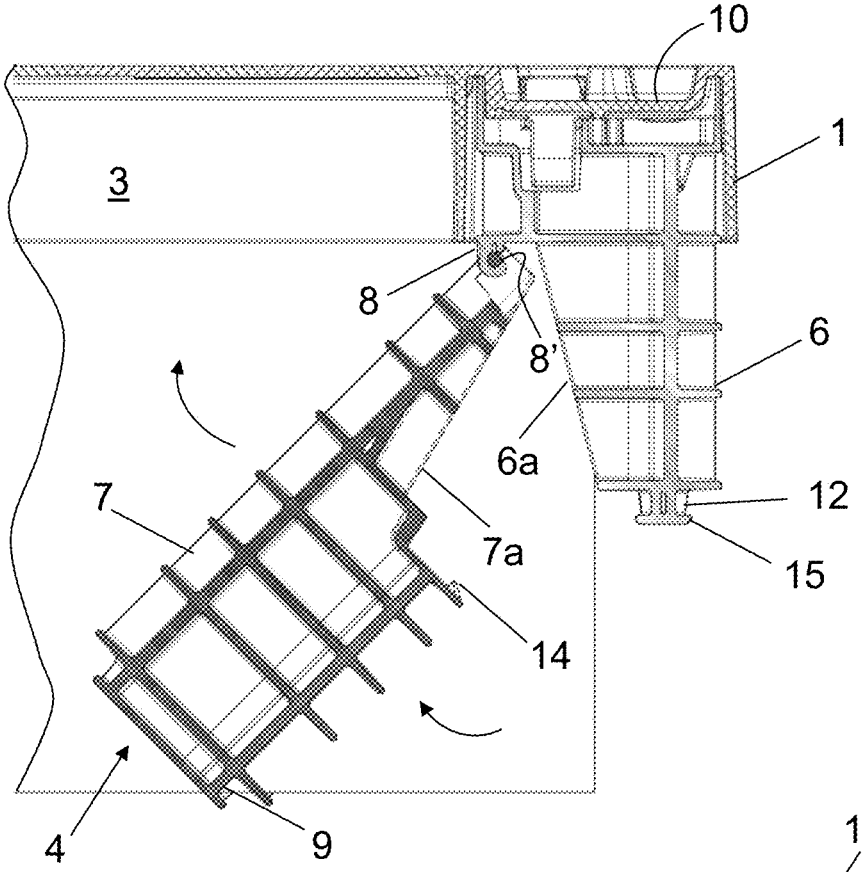
FIG. 2*b* shows a support in cooperation with the frame in an enlarged view according to IIb in FIG. 2*a* with the lower element pivoted out.
Figure 2C:
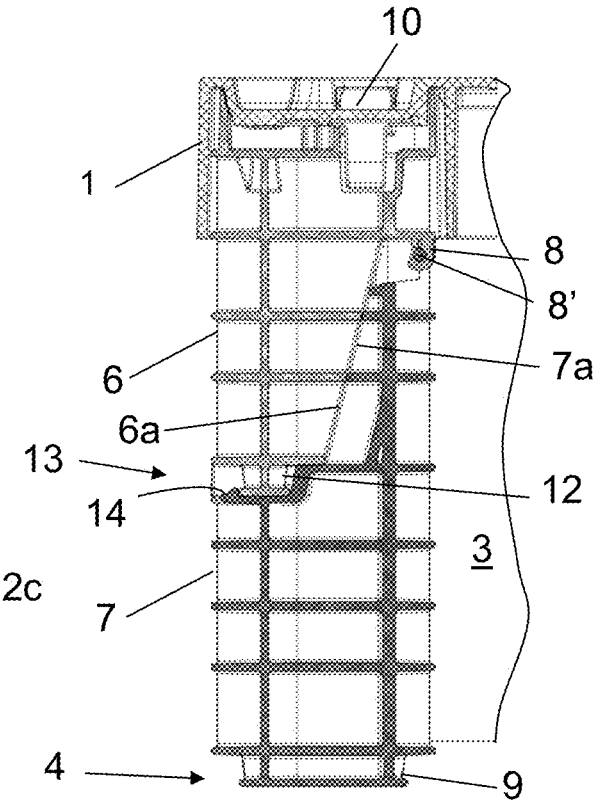
FIG. 2*c* shows a support in cooperation with the frame in an enlarged view according to IIb from FIG. 2*a* with the lower and upper elements brought together.
Figure 3:
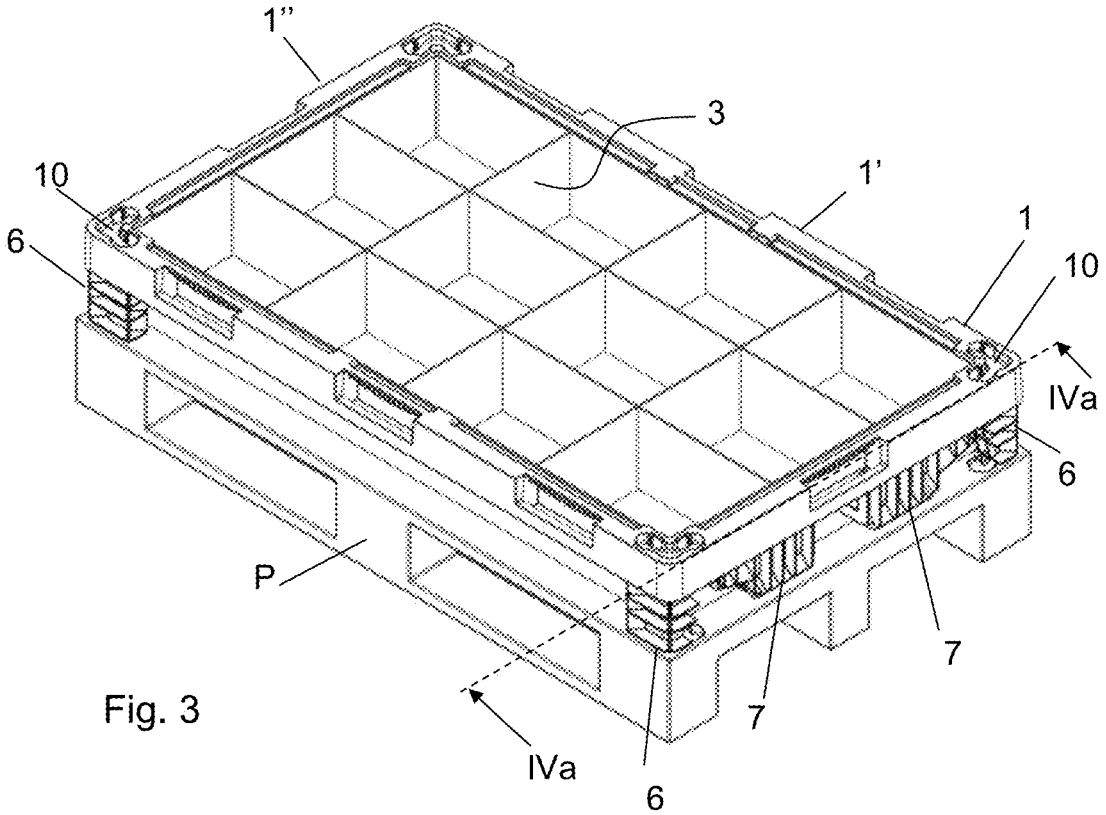
FIG. 3 shows the frame from FIGS. 1 and 2*a-c* with supports adjusted to a partial height by pivoting the lower elements of the supports away from the upper element. The frame is arranged on a pallet.

FIGS. 2*b* and 2*c* show the supports from FIG. 2*a* in detail, with FIG. 2*b* illustrating the support shown on the right and FIG. 2*c* illustrating the support shown on the left. They each show the hinge 8 and the two elements 6 and 7, wherein in FIG. 2*c*, the elements 6 and 7 are joined together and in FIG. 2*b*, the lower element 7 is moved away from the upper element 6 and is in a pivoted-out position. The lower element 7 can be pivoted away from the upper element at the hinge 8 according to the direction of the arrow and brought to a horizontal position where it would run parallel to the frame 1, as shown in FIG. 3. For this purpose, the axis 8' of the hinge 8 runs parallel to one side of the frame 1, in this example parallel to the long side 1' of the frame.

The surfaces 6*a*, 7*a* of the upper and lower elements 6 and 7 facing each other, i.e. the surface 6*a* of the upper element 6 and the surface 7*a* of the lower element 7, extend at an angle to the vertical in the example shown. On the one side, the lower element 7 extends upwards from the foot 4 of the support to the partial height up to the lower end of the upper element 6. The surface 7*a* of the lower element 7 extends from there further to the hinge 8. Similarly, the surface 6*a* of the upper element extends from the hinge 8 obliquely downwards up to the lower end of the upper element 6, which, as mentioned above, optimizes the transmission of force and takes load off the hinge.

Figure 7:
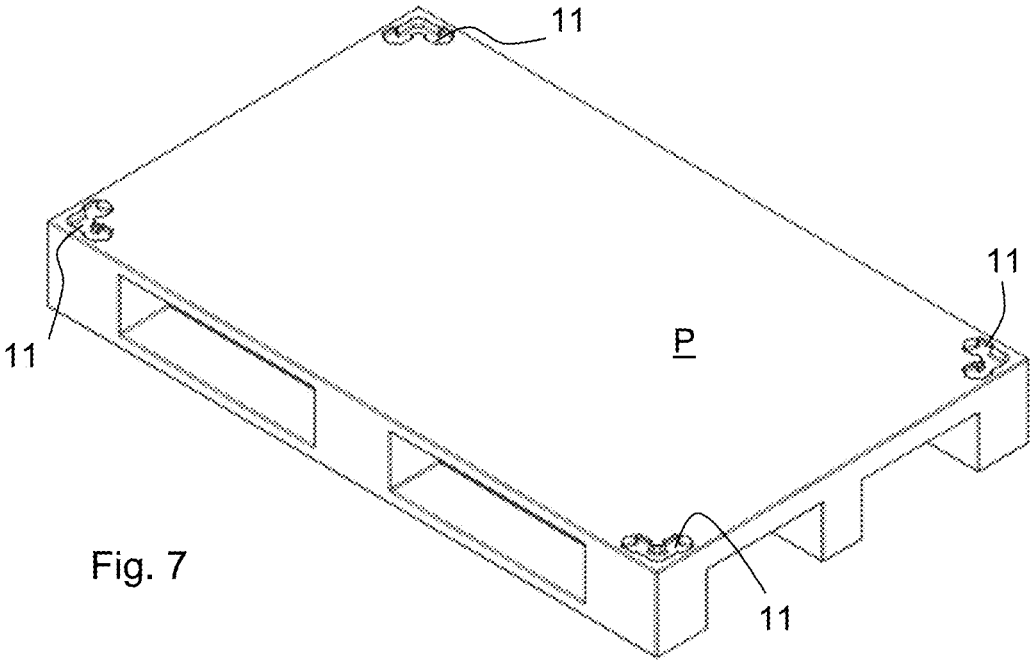
FIG. 7 shows a pallet with recesses in the corners into which projections at the feet of the supports and projections at the lower ends of the upper elements of the supports can be inserted and locked.

FIGS. 2*b* and 2*c* also show the configuration of the lower ends of the two elements 6 and 7. The foot 4 of the support 2 as shown in FIGS. 2*c* and 2*b* has a projection 9 which can be placed in a recess in a pallet or in the upper side of a corner of a frame 1. A corresponding recess 10 is shown in the frame 1 in all figures. FIG. 7 also shows a pallet P in which corresponding recesses 11 are arranged in the corners of the pallet P and on which the supports of a frame can be inserted. The projections 9 on the supports and the recesses 10 and 11 in the frame and pallet, respectively, serve for locking the frames in place when multiple frames are stacked or placed on a pallet.

The lower end of the upper element 6 also has a projection 12, as shown in FIGS. 2*a*, 2*b* and 2*c*. This projection 12 also serves for placing the support 2 with a shortened height, i.e. partial height, on a frame or pallet by placing the projection 12 in a corresponding recess. In addition, the projection 12 serves for releasably fixing the lower element 7 to the upper element 6 in closed position by means of a snap connection 13. For this purpose, the lower element 7 has a barb 14 which can snap into place at an edge 15 on the projection 12.

Figure 4A:
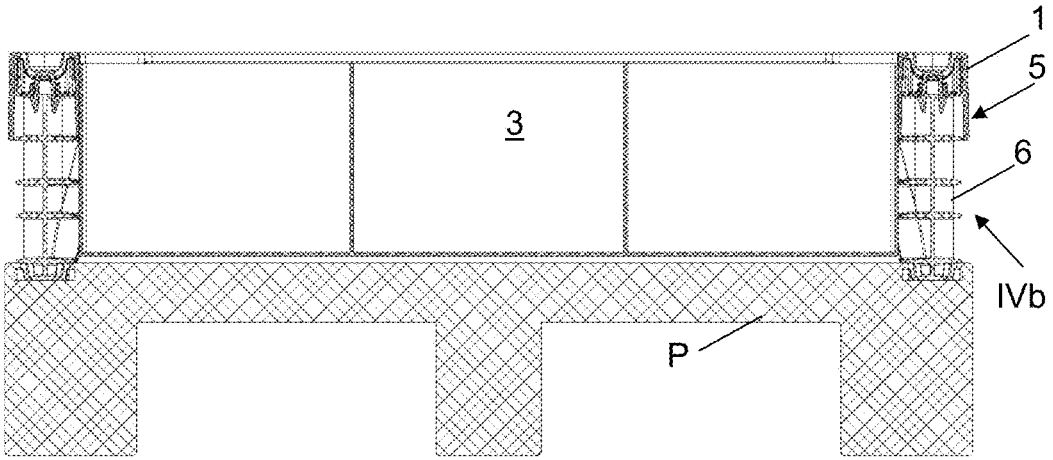
FIG. 4*a* shows the frame on a pallet from FIG. 3 in a section according to IVa-IVa.
Figure 4B:
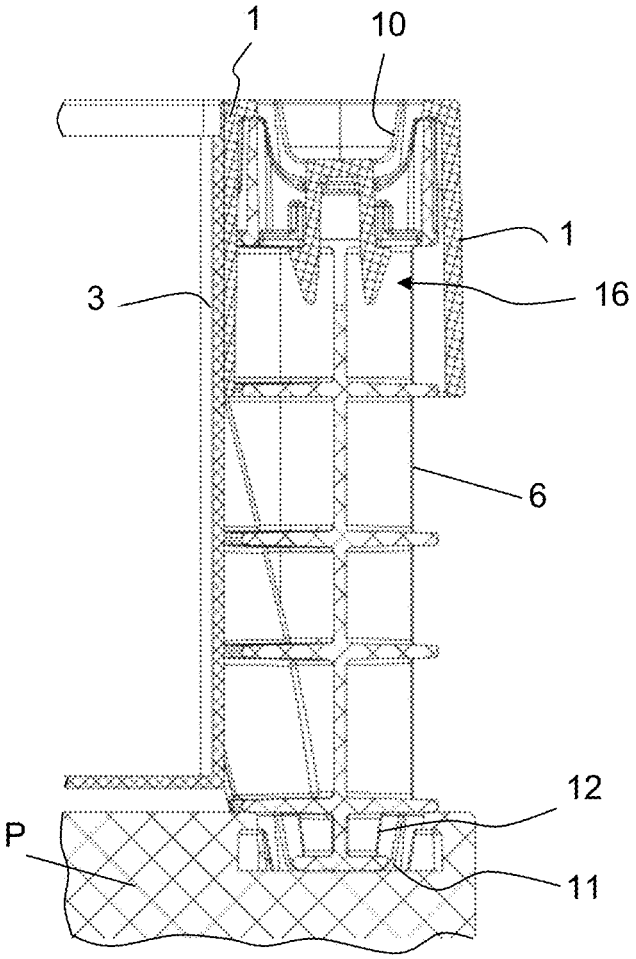
FIG. 4*b* shows the upper element of the support in cooperation with the frame and with a pallet therebelow in an enlargement according to IVb in FIG. 4*a*.

If all four supports 2 are adjusted in height in this manner by pivoting the lower element 7 away from the upper element 6 at each support 2 and bringing it into a horizontal position, the frame 1 obtains a partial height from the height of the upper element 6 and can be used in this shortened form, for example can be placed on a pallet. This shortened form of the frame 1 is shown in FIGS. 3, 4*a* and 4*b*. The upper elements 6 stand with their lower end on the pallet P while the lower elements 7 are pivoted out and run parallel to the frame. In this example, the lower elements 7 are each pivoted within the short sides 1" of the frame 1. In this folded-out position, an insert 3 having a smaller depth can be used to transport goods of appropriate size. In this position, empty transportation of frames with a smaller total volume is also possible.

FIGS. 4*a* and 4*b* show the frame 1 according to the invention in a further sectional view and in particular the attachment of the shortened supports 2 and of the insert 3 to the frame 1. The upper element 6 of the supports is fastened at the head 5 of the support 2 to the lower side of the frame 1 by means of snap connections 16. The insert 3, for example made of textile, is attached to the frame 1 by welding.

FIGS. 4*a* and 4*b* also show the placement of the shortened support 2 in a pallet by inserting the projection 12 at the lower end of the upper element 6 into the recess 11.

Figure 5:
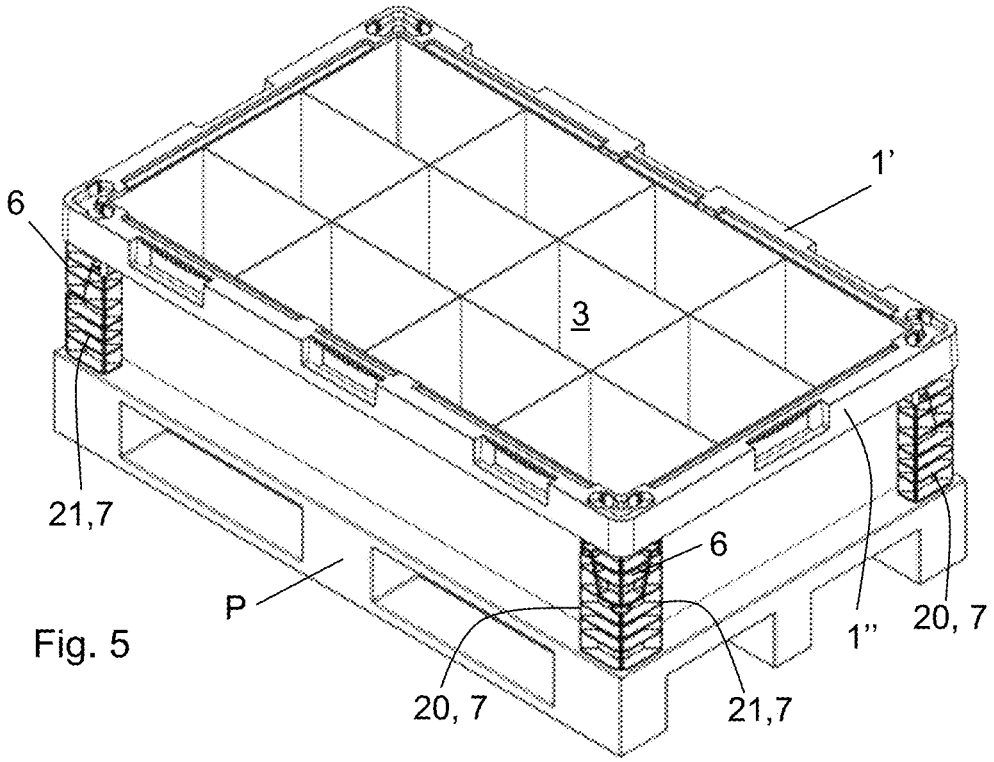
FIG. 5 shows a variant of the frame according to the invention, in which the lower element consists of two parts, each of which can be pivoted away from the upper element by means of a hinge.
Figure 6:
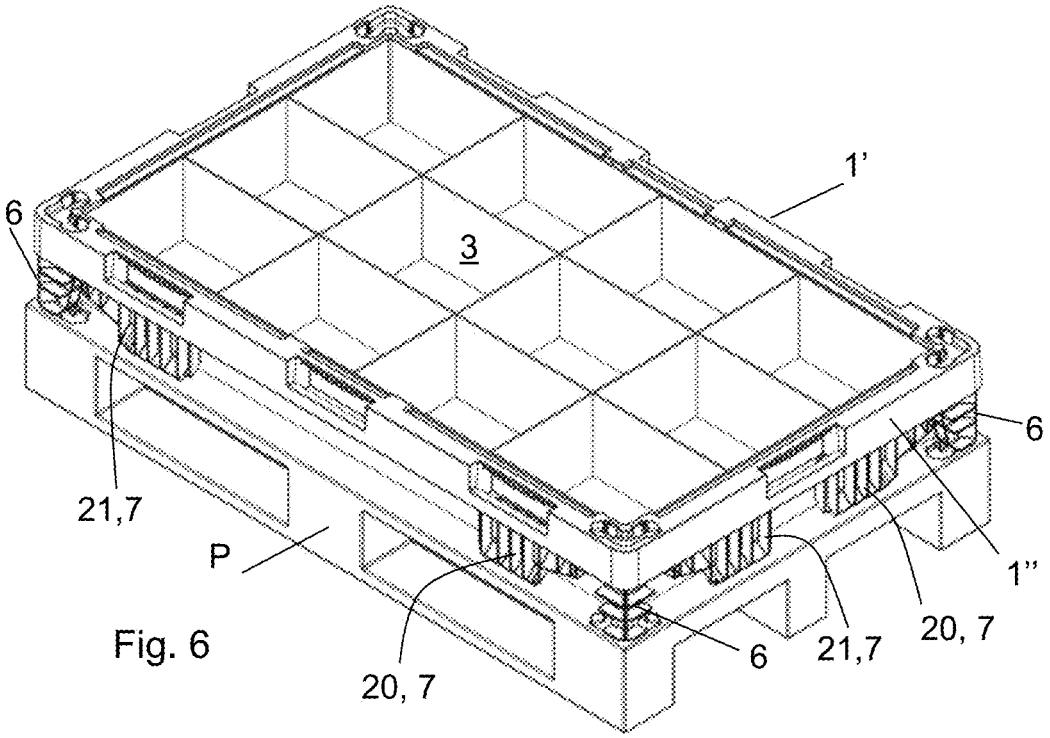
FIG. 6 shows the frame from FIG. 5 with the supports adjusted to the partial height.

FIGS. 5 and 6 show a variant of the frame 1 according to the invention in which the lower elements 7 of the supports 2 each consist of two parts 20, 21. Both parts 20 and 21 are each pivotally connected to the upper element 6 by means of a hinge and can be moved away from the upper element 6 and brought into a horizontal position and brought back into a vertical position and brought together with the upper element.

FIG. 5 shows this variant with parts 20 and 21 in the closed position in which they are joined to the upper element 6. Here, the supports 2 are at their full height. FIG. 6 shows the variant with shortened height of the supports with the parts 20 and 21 each pivoted laterally, in each case in opposite directions, away from the upper element 6. The first part 20 of the lower element 7 is moved towards the long side 1' of the frame 1 while the second part 21 of the lower element 7 is moved towards the short side 1" of the frame 1, so that each of the two parts run parallel to the frame 1. The upper element 6 is placed by means of a projection at its lower end into a recess in the pallet P.

In the exemplary embodiment in FIGS. 5 and 6, the parts 20 and 21 of the lower element 7 are each formed to have the same height.

In all variants, the pivoted-out lower element 7 can be attached in its horizontal position to the lower side of the frame 1. This facilitates handling of the frame when the height of the supports 2 is changed. Suitable for attachment are, for example, a releasable snap connection and connections by means of lugs or other fastening means. This applies to one-piece as well as two-piece lower elements.

In another variant of the example in FIGS. 5 and 6, the parts 20 and 21 of the lower element can also be formed to have different heights. To adjust the height of the support from the full maximum height to a first shortened height, a first part of the lower element is pivoted out while the second part of the lower element remains vertical. The support would then rest on the lower end of the second part of the lower element.

For further adjustment of the height of the support from this partial height to an even lower height, the second part of the lower element is also pivoted out so that only the upper element is vertical and the support stands on the lower end of the upper element, as shown in FIGS. 6 and 3.

Figure 8:
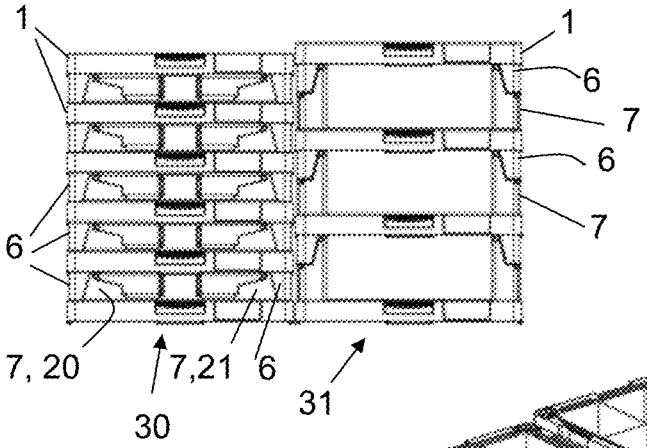
FIG. 8 shows a stack of frames according to the invention with supports with full height and with supports with partial height in a perspective view.
Figure 9:
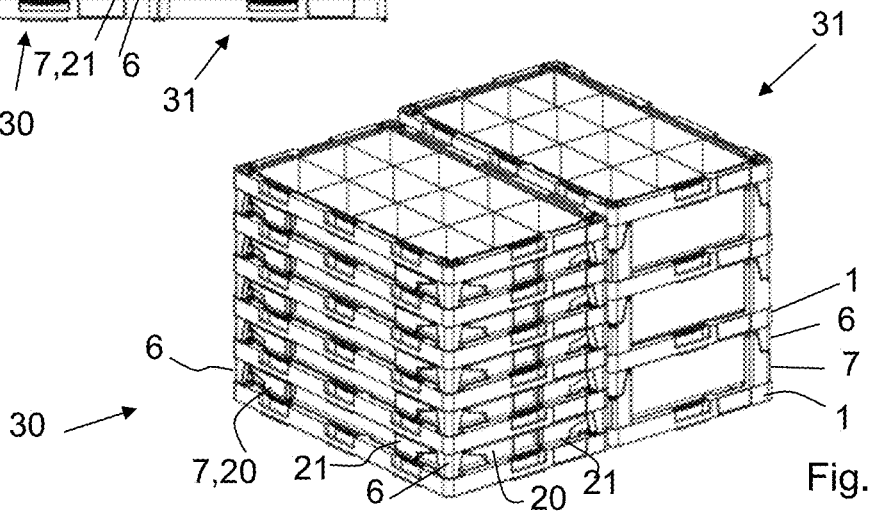
FIG. 9 shows the stack from FIG. 8 in a view from the front.

FIGS. 8 and 9 show two stacks 30, 31 of frames 1 according to the invention standing next to each other, each with three-part supports, wherein in the left stack 30, the frames 1 are set at a partial height of the supports which are equal to the height of the upper elements 6, and in the right stack 31, the supports of the frames 1 have their full maximum height equal to the height of the upper element 6 together with the two parts of the lower element 7.

In the left stack there are six frames with short inserts, while in the right stack there are three frames stacked with deeper inserts. It is also shown how a stack with supports at a partial height allows empty transportations of such frames with reduced volume.

Figure 10A:
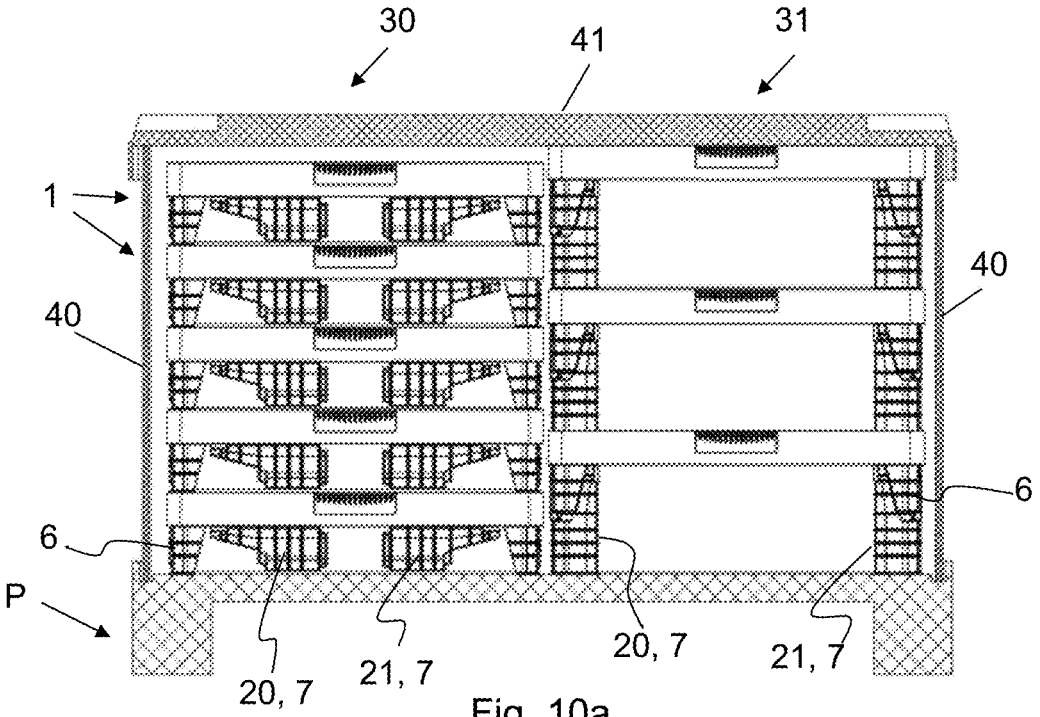

FIG. 10*a* shows a side view of two stacks 30 and 31 of frames 1 according to the invention as shown in FIGS. 8 and 9, here in an application in which the stacks 30, 31 stand on a pallet P and are enclosed by vertically standing side walls of twin-wall sheets 40. Such a packing system is also known in the trade under the term "sleeve packing". The twin-wall sheets 40 are covered by a cover plate 41 which rests on the upper edges of the twin-wall sheets 40 and on the uppermost frame 1 of the stack 31. In the stack 30 of frames 1, the frames are each at a shortened height with the supports 20 and 21 of the lower element 7 folded in. In the stack 31 on the right, the supports are at full height.

Figure 10B:
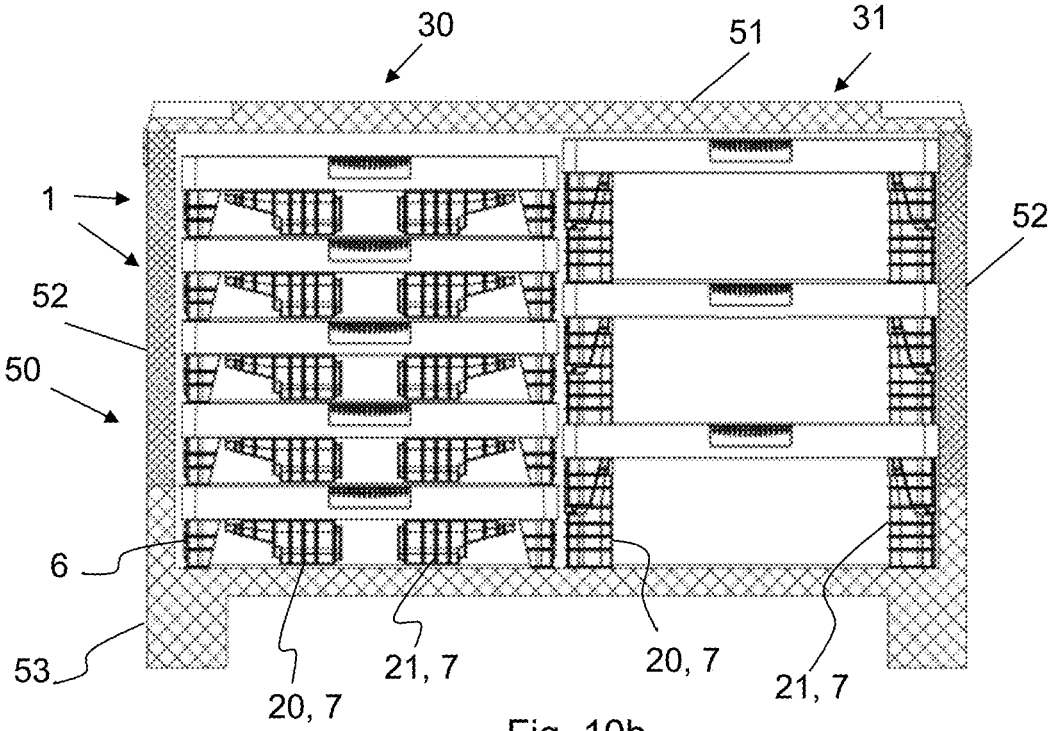

FIG. 10*b* shows a side view of the same two stacks 30 and 31 of frames 1 according to the invention as in FIGS. 8 and 9, these being shown in an application in which they are arranged in a pallet container 50. The pallet container 50 is covered with a cover plate 51. It has, for example, fold-out side walls 52 which stand on a base, here a pallet 53.

Although various embodiments of the present invention have been described and shown, the invention is not restricted thereto, but may also be embodied in other ways within the scope of the subject-matter defined in the following claims.

What is claimed is:

1. A frame for a pallet and for accommodating an insert for goods, comprising four sides and four length-adjustable supports each extending from a foot to a head, wherein each head of the supports is fastened to the frame, wherein the four supports each have an upper element and a lower element pivotally connected to each other by means of a hinge, wherein in a first position of each support, the upper element and the lower element are brought together in each case by means of the hinge, and the supports form a maximum height, and wherein in a second position of each support, in each case the lower element is pivotally moved away from the upper element and towards the frame, wherein the hinge is arranged in the upper region of the upper element of the support near the head of the support close to the frame, wherein the upper element comprises the head of the support and extends from the head downwards to a lower end of the upper element, and the lower element comprises the foot of the support and extends from the foot upwards to the lower end of the upper element and to the hinge, wherein by means of the hinge, the lower element and the upper element of the supports can be moved towards each other and away from each other, wherein the upper element has surfaces and the lower element has surfaces which face each other and are in contact with each other in the first position, and wherein in the second position, the supports form a partial height which is equal to the height of the upper element.

2. The frame according to claim 1, wherein the axis of the hinge in each case runs parallel to one of the sides of the frame.

3. The frame according to claim 1, wherein the surfaces of the upper element and the surfaces of the lower element, which face each other, run at an angle to the vertical.

4. The frame according to claim 1,
wherein
the upper element and the lower element of each support can each be connected to each other in each case by means of a releasable snap connection.

5. The frame according to claim 1,
wherein
the frame has in each case one recess on its upper side in each of the corners.

6. The frame according to claim 1,
wherein
the lower end of the lower element of each support has a downwardly directed projection.

7. The frame according to claim 1,
wherein
the lower end of the upper element of each support has a downwardly directed projection.

8. The frame according to claim 1,
wherein
the lower element comprises two parts each pivotally connected to the upper element by means of a hinge, wherein the two parts of the lower element can each be pivoted at their hinge away from the upper element and parallel to the frame, wherein the first part of the lower element can be moved towards the long side and the second part of the lower element can be moved towards the short side of the frame.

9. The frame according to claim 8,
wherein
the two parts of the lower element are implemented to be of equal length.

10. The frame according to claim 8,
wherein
the lower element can be fastened to the frame in the pivoted-out position.

11. The frame according to claim 1,
wherein
an insert can be fastened to the frame and removed again, wherein the insert is made of plastics, textile material, cardboard or metal or thermoformed parts.

12. The frame according to claim 1,
wherein
the frame has an insert made of textile, which is fastened to the frame by means of welding or gluing.

13. The frame according to claim 11,
wherein
the frame has projections on its inner sides on which an insert can be held.

14. The frame according to claim 11,
wherein
the frame has elements such as hooks, tabs or snap fasteners to which an insert can be hooked or fastened.

* * * * *